US006334454B1

(12) United States Patent
Williams

(10) Patent No.: US 6,334,454 B1
(45) Date of Patent: Jan. 1, 2002

(54) COLLAPSIBLE UMBRELLA WITH SHEATHING HANDLE

(76) Inventor: Richard C. Williams, 700 Glasgow Cir., Danville, CA (US) 94526

( * ) Notice: Subject to any disclaimer, the term of this patent is extended or adjusted under 35 U.S.C. 154(b) by 0 days.

(21) Appl. No.: 09/435,952

(22) Filed: Nov. 9, 1999

(51) Int. Cl.[7] ..... A45B 25/24

(52) U.S. Cl. ..... 135/25.41; 135/18; 135/34.2

(58) Field of Search ..... 135/15.1, 16, 18, 135/25.4, 25.41, 34.2, 34.41, 44, 48, 24; 220/293, 288; 401/243, 246, 269

(56) References Cited

U.S. PATENT DOCUMENTS

| | | | | | |
|---|---|---|---|---|---|
| 868,326 | A | | 10/1907 | Casale | |
| 892,813 | A | | 7/1908 | Dolles | |
| 1,885,968 | A | | 11/1932 | Wedemann | |
| 2,091,676 | A | | 8/1937 | Fliegner | |
| 2,164,242 | A | * | 6/1939 | Henry | 135/25.41 |
| 2,172,549 | A | * | 9/1939 | Solomon | 135/25.41 |
| 2,736,329 | A | * | 2/1956 | Cornellier | 135/25.41 X |
| 3,730,199 | A | | 5/1973 | Thur | |
| 3,744,502 | A | | 7/1973 | Weber | |
| 3,759,278 | A | * | 9/1973 | Hoffmann | 135/25.4 X |
| 4,456,023 | A | | 6/1984 | Fujihashi | |
| 4,522,300 | A | * | 6/1985 | Hamblet | 135/16 X |
| 4,624,275 | A | * | 11/1986 | Baldwin | 135/25.41 X |
| 5,111,835 | A | | 5/1992 | Lin | |
| 5,280,799 | A | * | 1/1994 | Alajajian | 135/16 |
| 5,465,743 | A | | 11/1995 | Sheu et al. | |
| 6,015,077 | A | * | 1/2000 | Disher | 135/34.2 X |

FOREIGN PATENT DOCUMENTS

| | | | | |
|---|---|---|---|---|
| FR | 687608 | * | 8/1930 | 135/25.41 |

* cited by examiner

*Primary Examiner*—Winnie S. Yip
(74) *Attorney, Agent, or Firm*—Thomas R. Lampe

(57) ABSTRACT

A collapsible umbrella shaft is attached to a cap having two sets of threads formed thereon. The cap is attachable to a housing by the threads in two alternate orientations to close the interior of the housing. In one cap orientation the folded umbrella is in the interior of the housing and in the other cap orientation the umbrella is deployed externally of the housing.

10 Claims, 4 Drawing Sheets

COLLAPSIBLE UMBRELLA WITH SHEATHING HANDLE

TECHNICAL FIELD

This invention relates to apparatus including a collapsible umbrella and a housing for the umbrella which may be utilized either as a handle for the umbrella when it is not collapsed or a storage receptacle or repository for the umbrella when in collapsed condition.

BACKGROUND OF THE INVENTION

U.S. Pat. No. 4,456,023, issued Jun. 26, 1984, discloses a collapsible umbrella with a water-tight sheathing handle. The rigid tubular sheathing handle is attached to a central telescopic stick in such a way that the umbrella in a fully collapsed condition may be withdrawn in the sheathing handle in a completely water-tight manner when a sliding member fixed to the lower end of the stick is at the bottom of the tubular sheathing handle. The umbrella in a fully collapsed condition may be taken out of the sheathing handle to be opened for use when the sliding member is retained near the top end of the sheathing handle, thereby rendering the sheathing handle serviceable dually as a storage sheath when an umbrella is not in use and as a handle when it is in use.

The apparatus disclosed in U.S. Pat. No. 4,456,023 is relatively complicated, expensive and difficult to use. Furthermore, the collapsible umbrella must be of a specialized type, adding to the cost of the apparatus.

A number of other patents are known disclosing devices for containing a collapsed umbrella and functioning as a handle. Such arrangements are disclosed in the following United States Patents: U.S. Pat. No. 1,885,968, issued Nov. 1, 1932, U.S. Pat. No. 2,091,676, issued Aug. 31, 1937, U.S. Pat. No. 892,813, issued Jul. 7, 1908, U.S. Pat. No. 5,465,743, issued Nov. 14, 1995, U.S. Pat. No. 868,326, issued Oct. 15, 1907, U.S. Pat. No. 5,111,835, issued May 12, 1992, U.S. Pat. No. 3,730,199, issued May 1, 1973, and U.S. Pat. No. 3,744,502, issued Jul. 10, 1973.

DISCLOSURE OF INVENTION

The present invention is characterized by its simplicity and relatively low cost as compared to the devices disclosed in known existing patents. No specialized umbrella construction need be utilized. The combination disclosed and claimed herein is easy to use and allows storage of a collapsed umbrella in an absolutely water-tight manner, as compared to some prior art devices which do not have this capability.

The invention of the present invention encompasses a combination including a collapsible umbrella including an umbrella shaft having a first end and a second end, a folding canopy support attached to the first end of the umbrella shaft, and a canopy attached to the folding canopy support.

A cap is connected to the second end of the umbrella.

The combination also includes a housing defining a housing interior.

Connector means is provided for selectively releasably connecting the cap to the housing in two alternate orientations. The cap when in one of the orientations closes off the housing interior with the umbrella in collapsed condition within the housing interior, the housing functioning as a repository for the collapsed umbrella. The cap when in the other of the orientations closes off the housing interior and supports the umbrella in uncollapsed condition with the housing functioning as a handle for the umbrella.

Other features, advantages, and objects of the present invention will become apparent with reference to the following description and accompanying drawings.

MODES FOR CARRYING OUT THE INVENTION

Figure 1:
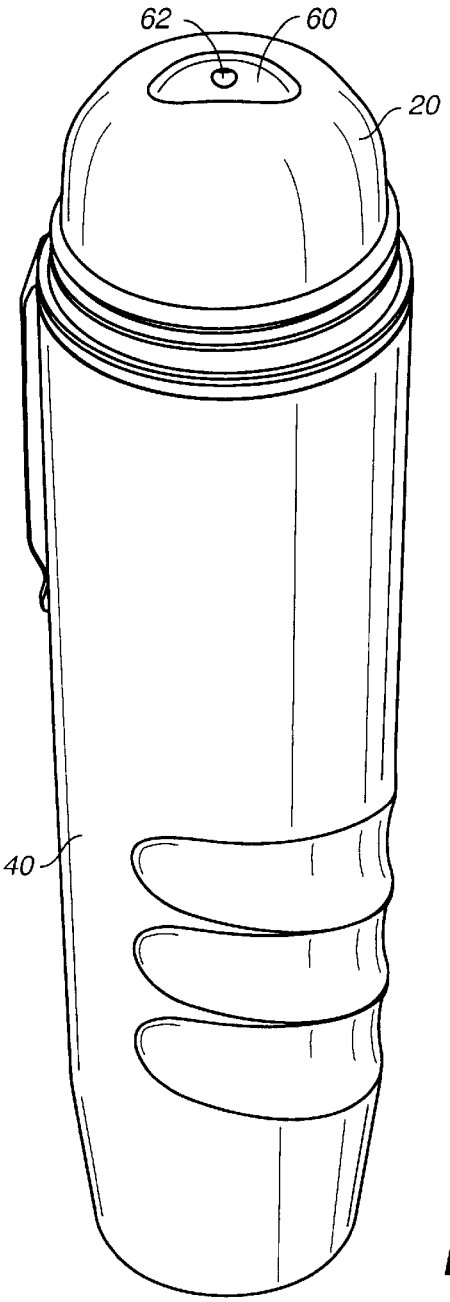
FIG. 1 is a perspective view of a preferred form of the invention with a cap secured to a housing to provide a water-tight container for a collapsed umbrella disposed within the housing.
Figure 2:
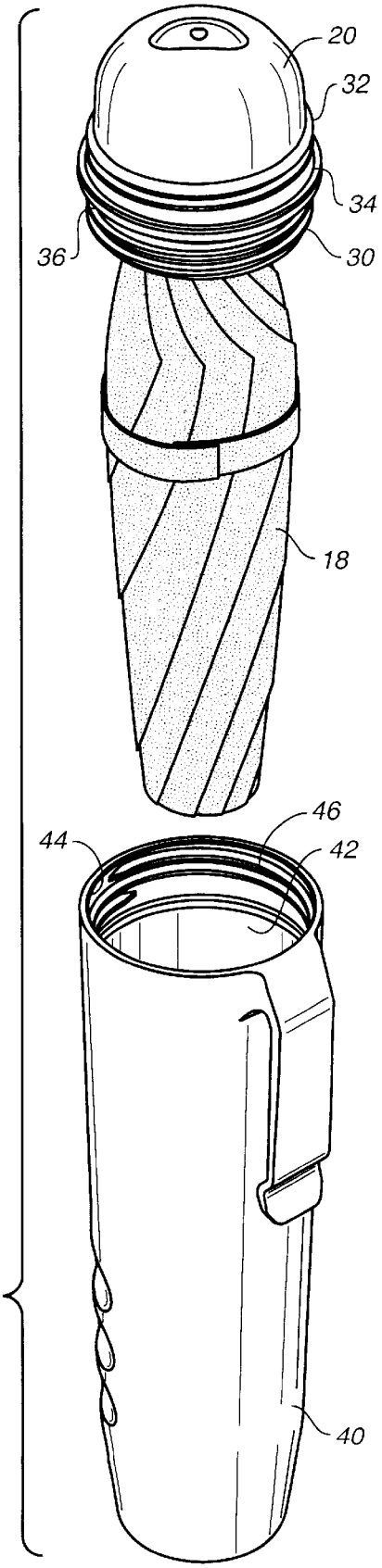
FIG. 2 is an exploded view illustrating the cap with a collapsed umbrella attached thereto prior to insertion of the collapsed umbrella within the housing and securement of the cap to the housing.
Figure 3:
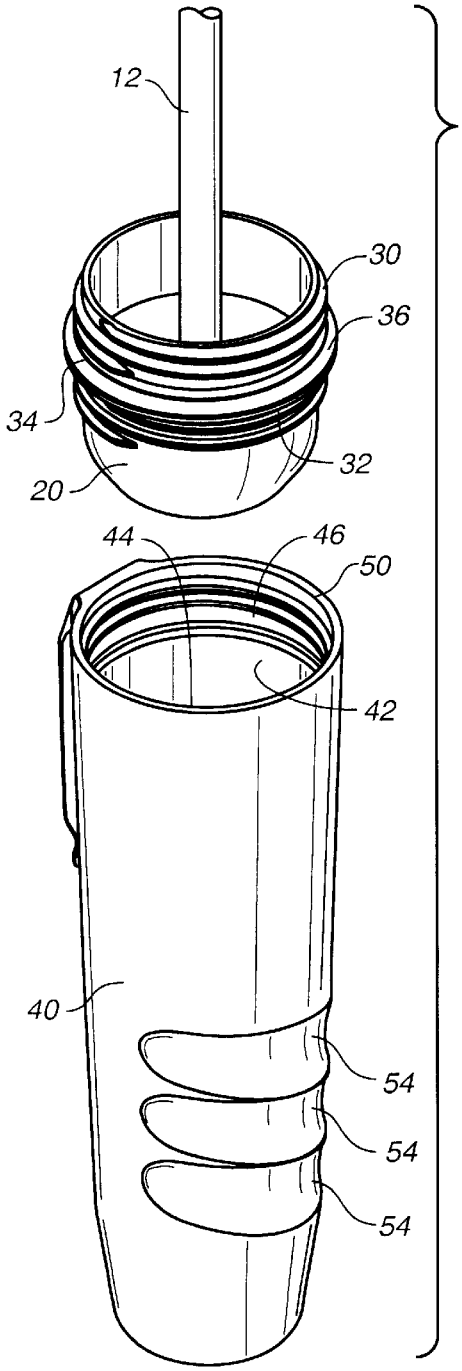
FIG. 3 is an exploded, perspective view illustrating the cap in a reversed orientation relative to the housing, a portion of the umbrella shaft projecting upwardly from the cap.

Referring now to FIGS. 1–5, a preferred embodiment of the present invention is illustrated. The invention includes a collapsible umbrella having an umbrella shaft 10 which is of conventional construction, including two telescoping portions 12 and 14. The shaft is double-ended, one end thereof being connected to a folding canopy support 16 of conventional construction. A canopy 18 of conventional construction is attached to the folding canopy support.

A cap 20 is attached to the end of shaft 10 remote from the point of attachment of the folding canopy support. More particularly, cap 20 has a receptacle 22 (FIG. 5) to which the shaft portion 12 is threadedly secured.

Cap 20 has two sets of screw threads 30, 32 formed thereon, the sets of screw threads being disposed adjacent to one another and separated by an annular rib 34. An O-ring seal 36 of any suitable resilient material such as rubber or plastic surrounds the cap and is in engagement with the annular rib 34.

Another component of the combination of the present invention is a housing 40 defining a housing interior 42. The housing is closed at one end thereof and defines an opening 44 at the other end thereof. The housing has screw threads 46 adjacent to the opening formed within the interior thereof.

Cap 20 may be threadedly secured to screw threads 46 of housing 40 in two different orientations. One orientation is shown in FIG. 1 wherein set of screw threads 30 is matingly engaged with the threads 46 of the housing. When the cap is in this orientation the O-ring seal 36 engages the rim 50 of the housing surrounding opening 44 to form a fluid-tight seal between the cap and housing. When the cap is in the orientation of FIG. 1 the folded umbrella and telescoped shaft are within the confines of the housing to capture any water on the umbrella.

Figure 5:
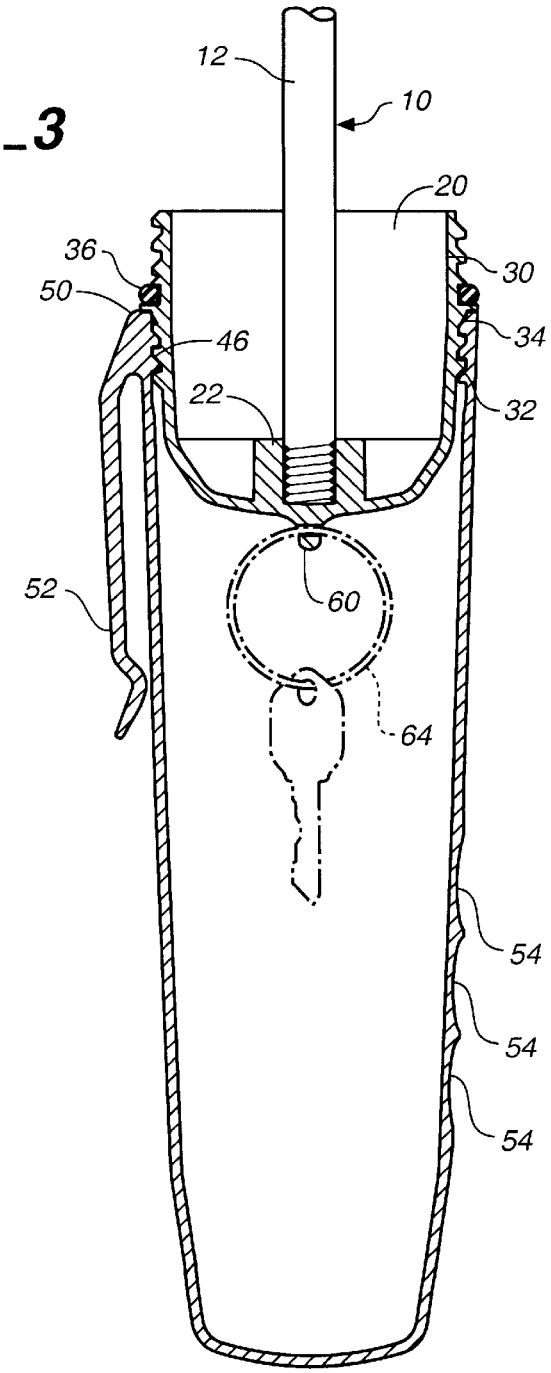
FIG. 5 is an enlarged, cross-sectional view illustrating the cap threadedly engaged with the housing and the umbrella shaft of the opened umbrella projecting outwardly from the cap and housing.

The cap 20 is also capable of having the orientation shown in FIG. 5 wherein the cap is inverted 180 degrees and is held in place on the housing to close off the interior of the housing due to engagement between screw threads 46 of the housing and the set of screw threads 32 on the cap. In this instance, the annular rib 34 bears directly against the housing rib 50.

Figure 4:
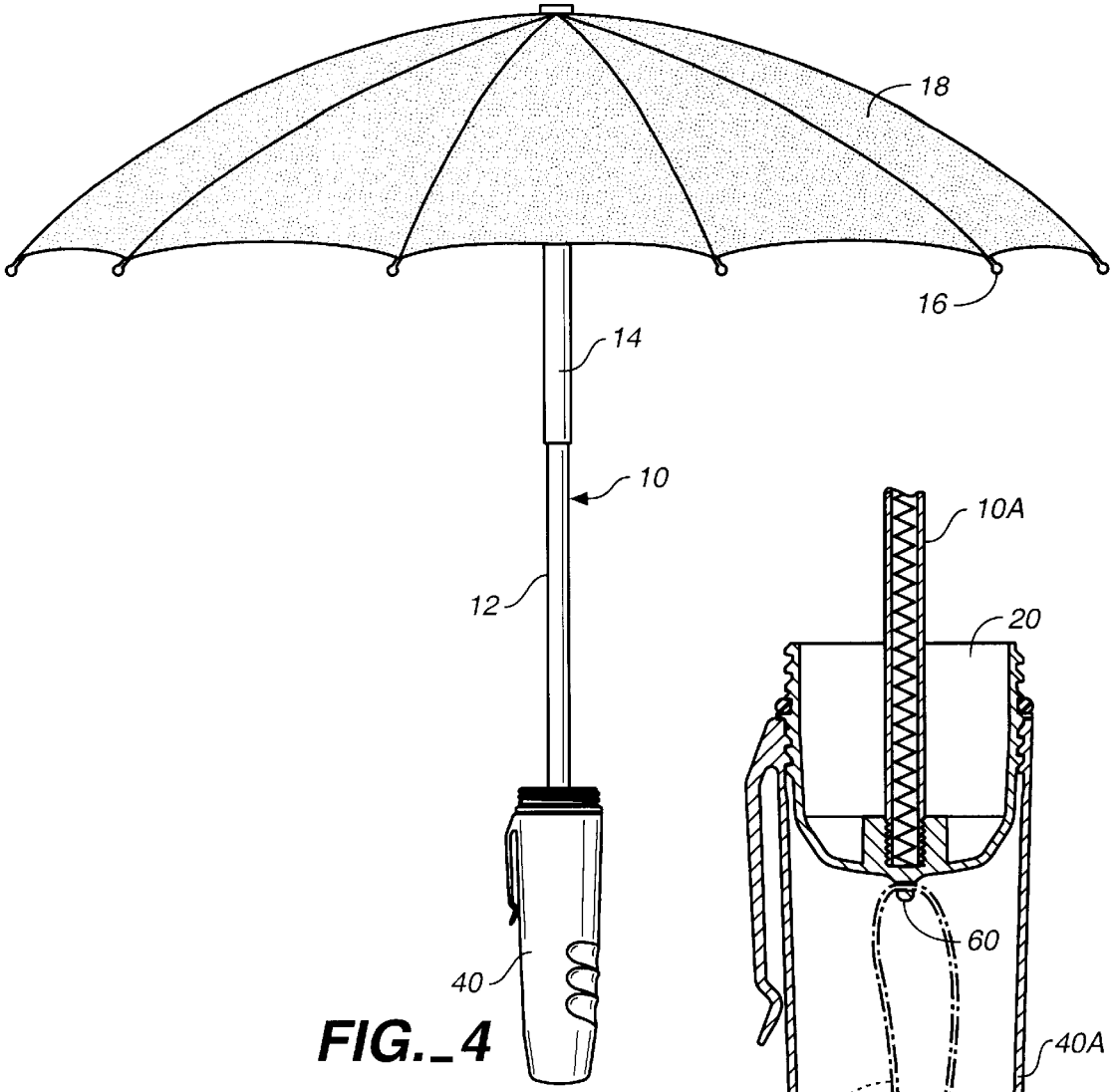
FIG. 4 is a front, elevational view of the umbrella in uncollapsed condition and extending upwardly from the cap which has been secured to the housing, the housing acting as a handle for the umbrella.

When the cap is oriented as shown in FIG. 5 the housing 40 acts as a handle for the umbrella which projects outwardly therefrom as shown in FIG. 4.

A clip 52 is attached to the housing so that the housing can be attached to a belt or other support. Recesses 54 are defined by the housing for receiving the fingers of a person holding the housing and utilizing it as an umbrella handle.

A protrusion 60 having an aperture 62 formed therein is affixed to the cap (preferably by being integrally formed therewith) for receiving an article such as the key-ring 64 shown in phantom in FIG. 5) to attach the article to the cap.

Figure 6:
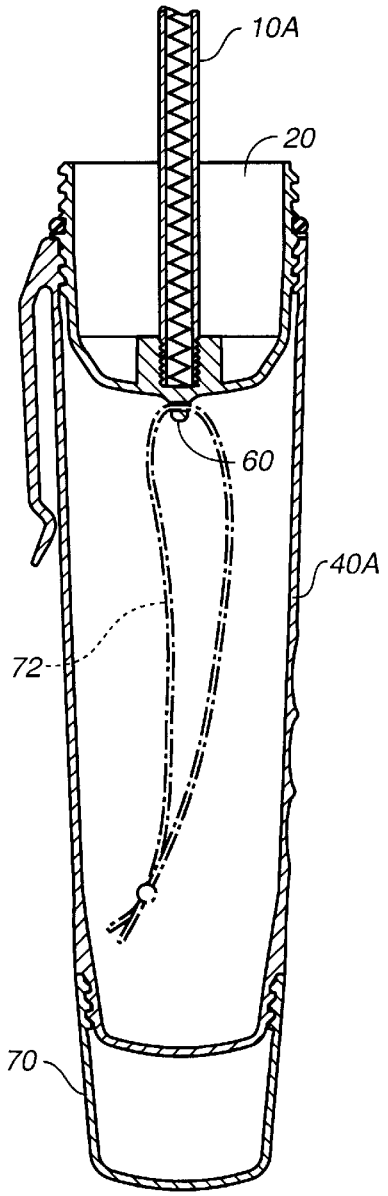
FIG. 6 is a view similar to FIG. 5 but illustrating an alternative embodiment of the apparatus.
Figure 7:
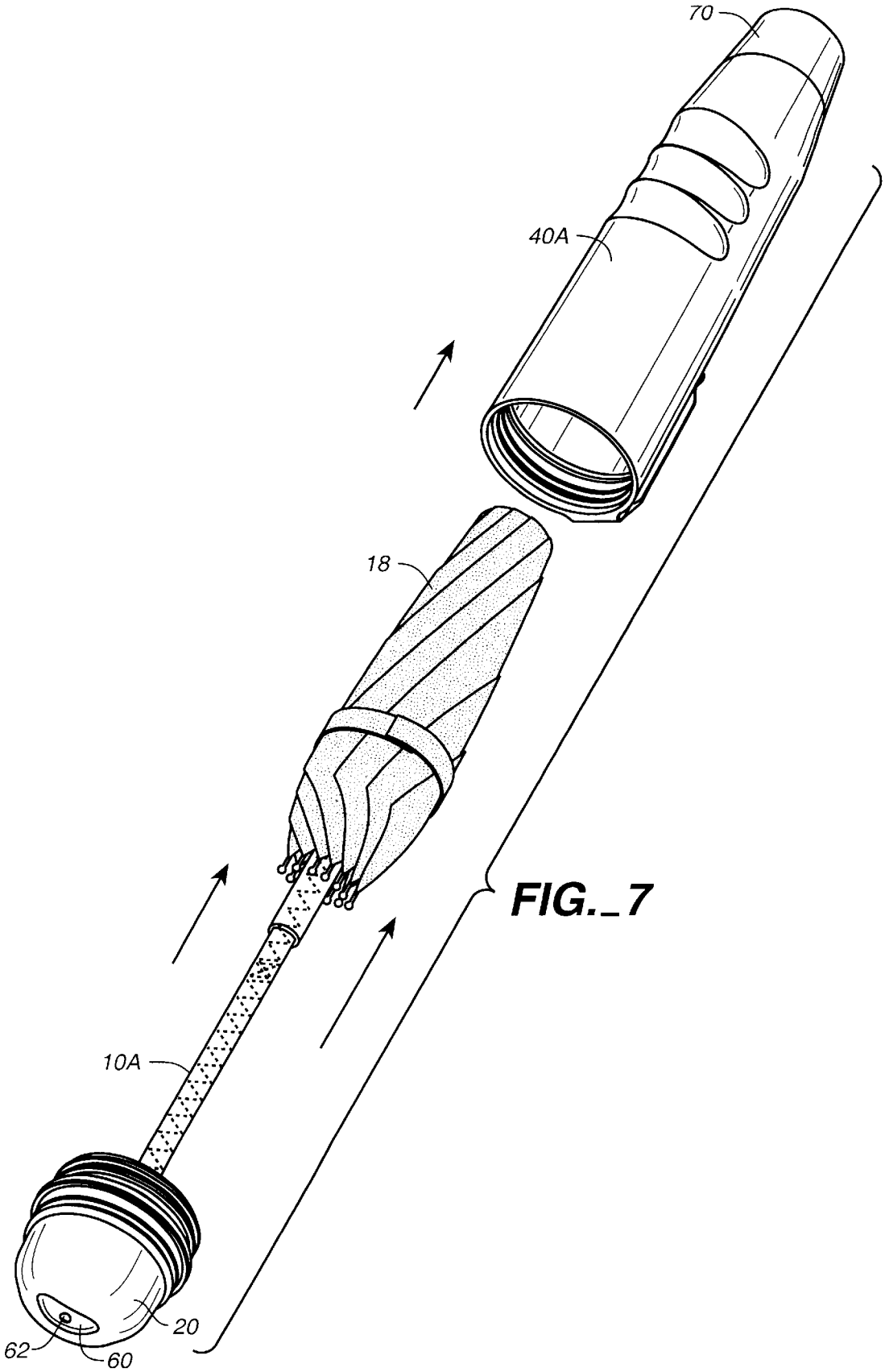
FIG. 7 is an exploded view illustrating the umbrella and cap of the alternate embodiment being positioned in the housing thereof.

FIGS. 6 and 7 illustrate an alternative form of the apparatus wherein cap 20 holds a spring biased, telescoping umbrella shaft 10A.

Housing 40A is threaded adjacent to the closed end thereof. A cup-like element 70 is threadedly connected to the closed end of the housing 40A and the interior of the cup-like element can be used to receive one or more objects to carry along with the umbrella or the element 70 can be removed for other purposes, e.g. to be employed as a drinking cup. In the illustrated embodiment of FIGS. 6 and 7, a carrier strap 72 is shown in phantom (in FIG. 6 only) attached to the protrusion 60 of the cap.

What is claimed is:

1. In combination:

a collapsible umbrella including an umbrella shaft having a first end and a second end, a folding canopy support attached to the first end of said umbrella shaft, and a canopy attached to said folding canopy support;

a cap connected to the second end of said umbrella shaft;

a housing defining a housing interior; and connector means for selectively releasably connecting said cap to said housing in two alternate orientations, said cap when in one of said orientations closing off said housing interior with the umbrella in collapsed condition within said housing interior with said housing functioning as a repository for the umbrella, and said cap when in the other of said orientations reversibly received within said housing interior and closing off the housing interior and supporting the umbrella in uncollapsed condition with said housing functioning as a handle for the umbrella, said connector means comprising screw threads on said cap and matingly engageable screw threads within said housing interior, said screw threads on said cap having two sets of screw threads externally disposed adjacent to one another on one end of said cap for said two alternative orientations.

2. The combination according to claim 1 additionally comprising seal means for forming a substantially liquid-tight seal between said cap and said housing when said cap is in one of said orientations and threadedly connected to said housing.

3. The combination according to claim 1 wherein said cap defines a receptacle receiving and holding the second end of said umbrella shaft.

4. The combination according to claim 2 wherein said seal means comprises an O-ring seal disposed about the outer periphery of said cap.

5. The combination according to claim 4 wherein said cap includes an annular rib, said O-ring seal being in engagement with said annular rib.

6. The combination according to claim 1 wherein said cap includes a cap end, said combination additionally comprising a protrusion defining an aperture affixed to said cap end for receiving an article and attaching the article to said cap.

7. The combination according to claim 1 additionally comprising a clip attached to said housing.

8. The combination according to claim 1 wherein said housing defines recesses for receiving the fingers of a person holding the housing.

9. The combination according to claim 5 wherein one set of said sets of screw threads is on one side of said annular rib and the other set of said sets of screw threads is on another side of said annular rib.

10. In combination:

a collapsible umbrella including an umbrella shaft having a first end and a second end, a folding canopy support attached to the first end of said umbrella shaft, and a canopy attached to said folding canopy support;

a housing defining an interior and an opening leading to said housing interior, screw threads being formed within said housing interior adjacent to said opening; and a cap having two sets of external threads formed adjacent one another on one end of said cap, said cap being connected to the second end of said umbrella shaft, the sets of external threads on said cap being alternately engageable with the screw threads on said housing interior enabling said cap to be reversibly connected to said housing in either a first orientation wherein said umbrella is located within said housing interior or a second orientation wherein said cap is reversibly held in said housing interior and said umbrella extends outwardly from said housing, said cap closing the opening of said housing when in either said first orientation or said second orientation.

* * * * *